US009351536B2

(12) United States Patent
Schindler et al.

(10) Patent No.: US 9,351,536 B2
(45) Date of Patent: May 31, 2016

(54) FOOTWEAR WITH FLUID BLADDER EXTENDING BETWEEN SOLE ASSEMBLY AND UPPER

(75) Inventors: Eric S. Schindler, Portland, OR (US); Klaas P. Hazenberg, Portland, OR (US); Dervin James, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 644 days.

(21) Appl. No.: 13/412,172

(22) Filed: Mar. 5, 2012

(65) Prior Publication Data

US 2013/0227857 A1 Sep. 5, 2013

(51) Int. Cl.

| | |
|---|---|
| ***A43B 7/06*** | (2006.01) |
| ***A43B 13/20*** | (2006.01) |
| ***A43B 23/02*** | (2006.01) |

(52) U.S. Cl.

CPC ..... *A43B 13/20* (2013.01); *A43B 23/029* (2013.01)

(58) Field of Classification Search

CPC ..... A43B 7/06; A43B 7/081; A43B 7/08; A43B 7/14; A43B 7/28; A43B 13/20; A43B 13/206; A43B 5/0405; A43B 17/03; A43B 17/026

See application file for complete search history.

(56) References Cited

U.S. PATENT DOCUMENTS

| | | | | |
|---|---|---|---|---|
| 3,685,176 | A * | 8/1972 | Rudy | 36/71 |
| 4,506,460 | A | 3/1985 | Rudy | |
| 5,113,599 | A * | 5/1992 | Cohen et al. | 36/88 |
| 5,313,717 | A | 5/1994 | Allen et al. | |
| 5,400,529 | A | 3/1995 | Bell et al. | |
| 5,444,926 | A * | 8/1995 | Allen et al. | 36/93 |
| 5,784,807 | A * | 7/1998 | Pagel | 36/93 |
| 5,806,208 | A * | 9/1998 | French | 36/28 |
| 5,827,459 | A | 10/1998 | Allen et al. | |
| 5,987,779 | A | 11/1999 | Litchfield et al. | |
| 6,014,823 | A * | 1/2000 | Lakic | 36/93 |
| 6,029,376 | A * | 2/2000 | Cass | 36/50.1 |
| 6,655,050 | B1 | 12/2003 | Lowe | |
| 6,871,421 | B2 | 3/2005 | Potter et al. | |
| 7,204,041 | B1 * | 4/2007 | Bailey et al. | 36/29 |
| 7,421,805 | B2 | 9/2008 | Geer | |
| 7,472,496 | B2 * | 1/2009 | Potter et al. | 36/88 |
| 7,478,488 | B1 * | 1/2009 | Davis et al. | 36/29 |
| 7,793,426 | B2 * | 9/2010 | Byrne et al. | 36/3 R |
| 2002/0170203 | A1 * | 11/2002 | Sanner | 36/3 R |
| 2003/0051373 | A1 * | 3/2003 | Goodwin | 36/29 |
| 2004/0045192 | A1 * | 3/2004 | Lin | 36/29 |
| 2004/0211084 | A1 * | 10/2004 | Marvin et al. | 36/3 A |
| 2005/0028404 | A1 * | 2/2005 | Marvin et al. | 36/45 |

(Continued)

*Primary Examiner* — Khoa Huynh
*Assistant Examiner* — Megan Brandon
(74) *Attorney, Agent, or Firm* — Honigman Miller Schwartz and Cohn LLP; Matthew H. Szalach; Jonathan P. O'Brien

(57) ABSTRACT

An article of footwear includes an upper having an anterior area, a posterior area, a medial area extending between the anterior and posterior areas, and a lateral area extending between the anterior and posterior areas and that is opposite the medial area. The article of footwear also includes a sole assembly operatively coupled to the upper. Furthermore, the article of footwear includes a bladder having a base operably supported by the sole assembly, an anterior portion that extends from the base toward the anterior area, a posterior portion that extends from the base toward the posterior area, a medial portion that extends from the base toward the medial area, and a lateral portion that extends from the base toward the lateral area. The anterior, posterior, medial, and lateral portions are operably supported by the upper.

20 Claims, 3 Drawing Sheets

(56) References Cited

U.S. PATENT DOCUMENTS

| | | | | |
|---|---|---|---|---|
| 2005/0034328 | A1 | 2/2005 | Geer | |
| 2005/0198858 | A1* | 9/2005 | Hsu | 36/3 A |
| 2005/0217145 | A1 | 10/2005 | Miyauchi et al. | |
| 2005/0278980 | A1 | 12/2005 | Berend et al. | |
| 2006/0048415 | A1* | 3/2006 | Marvin et al. | 36/93 |
| 2006/0162186 | A1* | 7/2006 | Marvin et al. | 36/45 |
| 2006/0272179 | A1* | 12/2006 | Passke et al. | 36/3 B |
| 2006/0277787 | A1* | 12/2006 | Vattes et al. | 36/3 A |
| 2007/0094891 | A1* | 5/2007 | Myslinski | 36/3 R |
| 2008/0098620 | A1* | 5/2008 | Marvin et al. | 36/29 |
| 2009/0084001 | A1* | 4/2009 | Sgattoni | 36/3 A |
| 2009/0090027 | A1* | 4/2009 | Baudouin | 36/93 |
| 2009/0100710 | A1 | 4/2009 | Potter et al. | |
| 2010/0037482 | A1* | 2/2010 | Litchfield et al. | 36/29 |
| 2010/0192410 | A1* | 8/2010 | Marvin et al. | 36/29 |
| 2011/0067264 | A1* | 3/2011 | Doyle | 36/29 |
| 2012/0011744 | A1* | 1/2012 | Bell et al. | 36/91 |
| 2012/0167270 | A1* | 7/2012 | Strong | 2/69 |
| 2012/0291314 | A1* | 11/2012 | Sokolowski et al. | 36/87 |
| 2013/0055595 | A1* | 3/2013 | Brown | 36/136 |

* cited by examiner

FOOTWEAR WITH FLUID BLADDER EXTENDING BETWEEN SOLE ASSEMBLY AND UPPER

FIELD

The present disclosure relates to footwear and, more particularly, relates to an article of footwear with a fluid bladder extending between a sole assembly and an upper thereof.

BACKGROUND

Articles of footwear can include an upper, a midsole, and an outsole. The upper can include layers or sections of material that wrap about a substantial portion of the superior, anterior, posterior, medial and lateral portions of the wearer's foot. The upper can also include laces, straps, or the like for securing the footwear to the wearer's foot. The outsole can be a unitary piece of relatively high-friction material that provides traction for the footwear. Also, the midsole can include foam that is disposed between the outsole and the upper for providing cushioned support for the wearer.

In some cases, footwear can additionally include a bladder that contains a fluid, such as a gas or gel. The bladder can be embedded within the midsole, and weight of the wearer and other loading on the bladder can cause the fluid to displace within the bladder. As such, the bladder can resiliently deform and conform to the wearer's foot in order to provide better support and comfort than some midsoles made entirely out of foam. Also, some bladders can be included within the upper, and the bladder can help the upper to fit more snugly against the wearer's foot for greater comfort. These bladders within the upper can also provide a degree of cushioning for the wearer.

Although conventional footwear with bladders have been adequate for their intended purposes, they do suffer from certain disadvantages. Bladders that extend through only a localized portion of the footwear may not sufficiently support the wearer's foot. For instance, the foot may shift laterally within the footwear, and the foot may apply pressure to the footwear at locations that are spaced away from the bladder. As such, the bladder may not provide sufficient support and comfort for the wearer.

SUMMARY

Accordingly, despite the improvements of known devices described above, there remains a need for an article of footwear that includes an upper that secures the article of footwear to a wearer. The upper has an anterior area, a posterior area, a medial area extending between the anterior and posterior areas, and a lateral area extending between the anterior and posterior areas and that is opposite the medial area. The article of footwear also includes a sole assembly operatively coupled to the upper. Furthermore, the article of footwear includes a bladder that contains a fluid. The bladder has a base operably supported by the sole assembly, an anterior portion that extends from the base toward the anterior area of the upper, a posterior portion that extends from the base toward the posterior area of the upper, a medial portion that extends from the base toward the medial area of the upper, and a lateral portion that extends from the base toward the lateral area of the upper. The anterior, posterior, medial, and lateral portions are operably supported by the upper.

An article of footwear is also disclosed that includes an upper for securing the article of footwear to a wearer. The upper includes a medial area, a lateral area opposite the medial area, and a superior forefoot area extending between the medial and lateral areas. The article of footwear also includes a sole assembly operatively coupled to the upper. Moreover, the article of footwear includes a bladder that contains a fluid. The bladder has a base operably supported by the sole assembly. The bladder also includes a medial portion operatively supported by the upper and extending from the base, through the medial area, and along the superior forefoot area. Furthermore, the bladder includes a lateral portion operably supported by the upper and extending from the base, through the lateral area, and along the superior forefoot area.

In still another aspect, an article of footwear is disclosed that includes an upper for securing the article of footwear to a wearer. The upper includes an anterior area, a posterior area, a medial area extending between the anterior and posterior areas, a lateral area extending between the anterior and posterior areas and that is opposite the medial area, and a superior forefoot area extending between the medial and lateral areas. The article of footwear also includes a sole assembly operatively coupled to the upper. In addition, the article of footwear includes a bladder that is embedded within both the upper and the sole assembly. The bladder contains a fluid, and the bladder has a base operably supported by the sole assembly and a plurality of ribs that radiate from the base. The base includes a plurality of through holes. Also, the plurality of ribs include an anterior rib that extends from the base, through the anterior area, and along the superior forefoot area. The plurality of ribs further include a plurality of posterior ribs that each extend from the base and toward the posterior area. Also, the plurality of ribs include a plurality of medial ribs that each extend from the base and toward the medial area. Moreover, the plurality of ribs include a plurality of lateral ribs that each extend from the base and toward the lateral area. The anterior, posterior, medial and lateral ribs are operably supported by the upper, and the anterior, posterior, medial and lateral ribs are in fluid communication with the base.

This section provides a general summary of the disclosure, and is not a comprehensive disclosure of its full scope or all of its features. Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
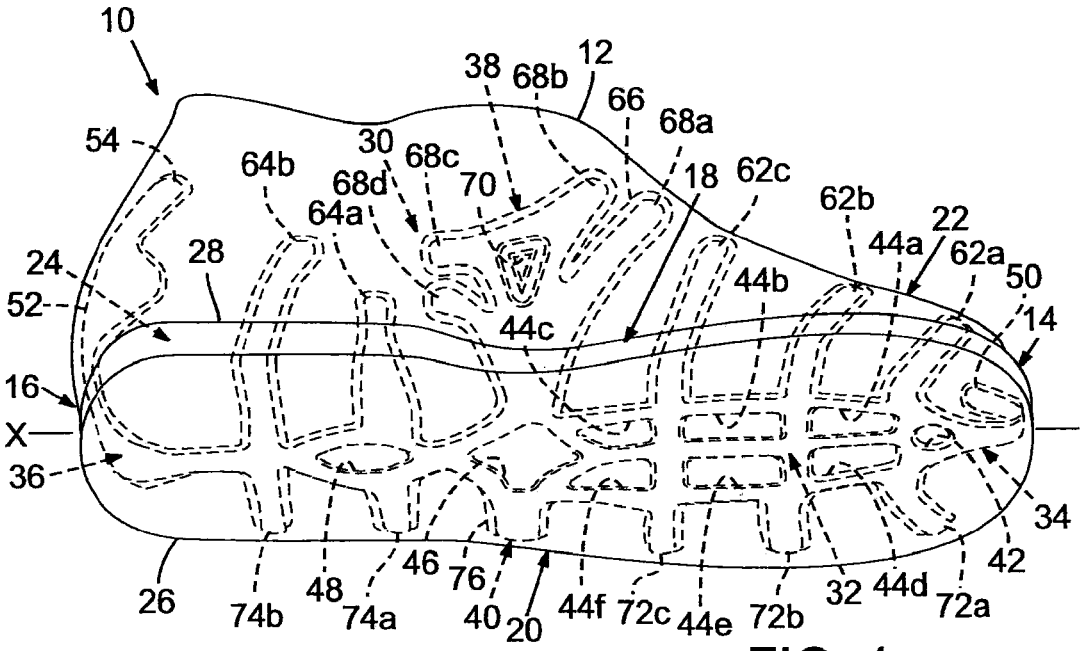
FIG. 1 is a perspective view of an article of footwear with a bladder.

Referring initially to FIG. 1, an exemplary embodiment of an article of footwear 10 is illustrated according to various teachings of the present disclosure. The article of footwear 10 can include an upper 12 that wraps around a portion of the wearer's foot (not shown) and that secures the article of footwear 10 to the wearer. The upper 12 can include various layers of material that partially overlap each other and that are operably secured to each other, for example, by stitching, adhesives, and the like. The upper 12 can additionally include a fastening structure, such as laces, buckles, pile tape and/or other features for tightly securing the upper 12 to the wearer's foot. It will also be appreciated that the upper 12 can include various decorative features for aesthetically enhancing the footwear 10. Moreover, it will be appreciated that the upper 12 can substantially cover the entire foot, such as a traditional shoe or boot, or the upper 12 can partially cover the foot, such as a sandal, etc., without departing from the scope of the present disclosure.

As shown in FIG. 1, the upper 12 can define an anterior area 14, a posterior area 16, and a longitudinal axis X that extends between the anterior and posterior areas 14, 16. In addition, the upper 12 can define a medial area 18 and a lateral area 20. The medial and lateral areas 18, 20 can extend between the anterior and posterior areas 14, 16, and the lateral area 20 can be disposed on a side of the axis X opposite the medial area 18. Additionally, the upper 12 can define a superior forefoot area 22. The superior forefoot area 22 can extend between the medial, anterior, and lateral areas 18, 14, 20. It will be appreciated that the anterior area 14 can substantially cover an anterior portion of the wearer's foot, the posterior area 16 can substantially cover the posterior portion of the wearer's foot, the medial area 18 can substantially cover the medial portion of the wearer's foot, and the lateral area 20 can substantially cover the lateral portion of the wearer's foot. Moreover, it will be appreciated that the superior forefoot area 22 can substantially cover a superior portion of the wearer's forefoot and toes.

The article of footwear 10 can further include a sole assembly 24. The sole assembly 24 can be operatively coupled to the upper 12 and can extend between the anterior, posterior, medial, and lateral areas 14, 16, 18, 20. The sole assembly 24 can include an outsole 26 and a midsole 28. The outsole 26 can include a layer of material made of relatively high-friction material and can include various grooves, recesses, projections, indentations, or other features for improving traction of the footwear 10. Moreover, the midsole 28 can include a foam material that is disposed between the outsole 26 and the upper 12. The midsole 28 can provide cushioned support of the sole of the wearer's foot. In addition, the outsole 26 can be secured to the midsole 28 and/or the upper 12 in any suitable fashion, such as adhesives, stitching, and the like.

Figure 2:
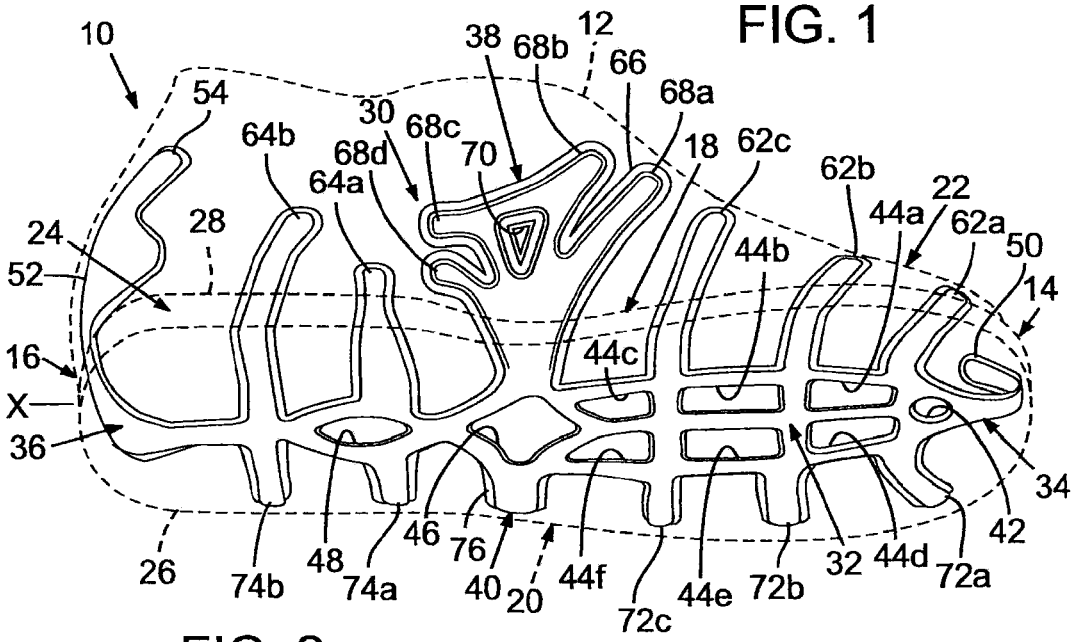
FIG. 2 is a perspective view of the bladder of FIG. 1.

The article of footwear 10 can additionally include a bladder 30, which is shown in phantom in FIG. 1 and is shown in solid lines in FIG. 2. The bladder 30 can include at least two layers of material (e.g., polymeric sheets) that are joined and sealed (e.g., plastic welded) along a periphery of the bladder 30. The bladder 30 can contain a fluid (e.g., gas, gel, etc.) that is substantially hermetically sealed therein. The bladder 30 can be operably supported by the sole assembly 24 and the upper 12, as will be discussed in greater detail below.

The bladder 30 can generally include a base 32, which can be embedded within the midsole 28. The bladder 30 can further include an anterior portion 34, a posterior portion 36, a medial portion 38 and a lateral portion 40. Each of the anterior, posterior, medial and lateral portions 34, 36, 38, 40 can extend and radiate from the periphery of the base and can wrap up and into the upper 12 as will be discussed. The anterior, posterior, medial and lateral portions 34, 36, 38, 40 can be embedded and operably supported by the upper 12. For instance, the upper 12 can include at least two layers of material (i.e., inner and outer layers) that cooperate to encase the anterior, posterior, medial, and lateral portions 34, 36, 38, 40 of the bladder 30. In other embodiments, the anterior, posterior, medial, and lateral portions 34, 36, 38, 40 can be exposed from the upper 12.

The base 32 of the bladder 30 can be in fluid communication with one or more of the anterior, posterior, medial, and lateral portions 34, 36, 38, 40 of the bladder 30. As such, fluid within the bladder can flow between the base 32 and the various portions 34, 36, 38, 40 of the bladder 30. Accordingly, the bladder 30 can provide cushioned support for the wearer by resiliently deflecting from the weight loads and other loads of the wearer.

Figure 4:
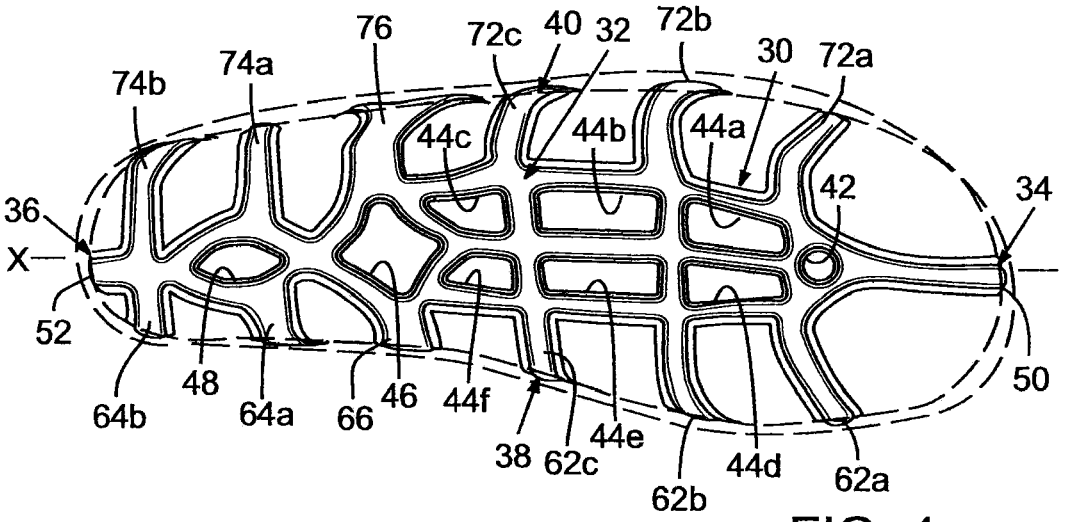
FIG. 4 is a bottom view of the bladder of FIG. 1.
Figure 5:
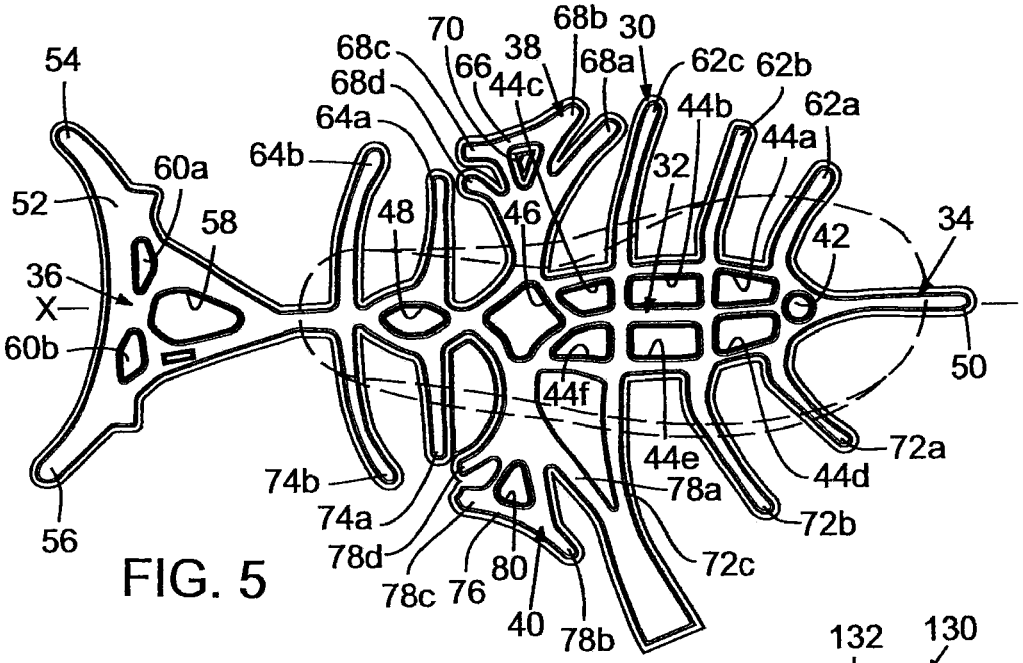
FIG. 5 is a plan view of the bladder of FIG. 1.

Referring now to FIGS. 2, 4, and 5, the base 32 of the bladder 30 will be discussed in greater detail. As shown, the base 32 can be generally flat and can extend along the axis X and between the medial and lateral areas 18, 20. Also, the base 32 can include a plurality of through holes, including a forward hole 32, a plurality of central holes **44*a*-44*f*, a first rear hole 46, and a second rear hole 48. The forward hole 42 can be substantially circular and can be disposed adjacent the anterior portion 34 of the bladder 30. The central holes 44*a*-44*f* can be polygonal in shape and can be arranged in rows along both sides of the axis X. The first rear hole 46 and the second rear hole 48 can be polygonal in shape and can be substantially centered on the axis X. It will be appreciated that the through holes 42, 44*a*-44*f*, 46, 48 can allow the material of the midsole 28 to be disposed therein to substantially secure the bladder 30 to the midsole 28. Also, it will be appreciated that the base 32** can provide cushioned support of the sole of the wearer's foot.

It will be appreciated that the base 32 of the bladder 30 can have any suitable shape. Furthermore, the base 32 can be substantially continuous instead of including the holes 42, **44*a*-44*f*, 46, 48 of the exemplary embodiments shown in FIGS. 1, 2, 4, and 5**.

Furthermore, the anterior portion 34 of the bladder 30 can include an anterior rib 50, as shown in FIGS. 1, 2, 4, and 5. In plan view (FIG. 5), the anterior rib 50 can be elongate and can be substantially axially straight. The anterior rib 50 can be substantially parallel to the axis X. The anterior rib 50 can extend from the base 32 and can extend generally in a superior direction toward the superior forefoot area 22 to be operatively supported by the superior forefoot area 22. As such, the anterior rib 50 can provide cushioning for one or more toes of the wearer.

Figure 3:
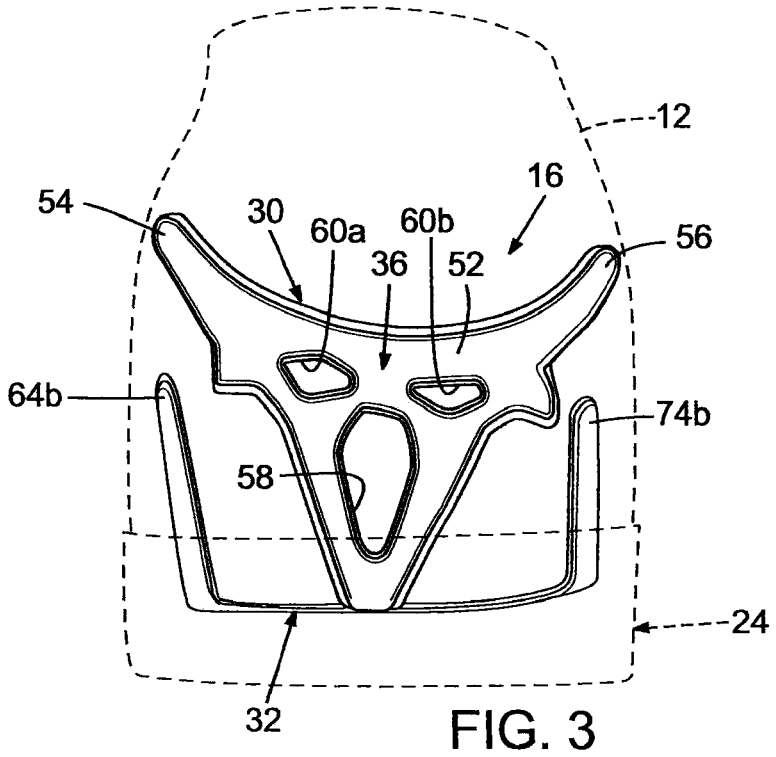
FIG. 3 is a rear view of the bladder of FIG. 1.

The posterior portion 36 of the bladder 30 can include a posterior rib 52. As shown in FIG. 3, the posterior rib 52 can be generally V-shaped or U-shaped. The posterior rib 52 can extend substantially parallel to the axis X. The posterior rib 52 can also include a first branch 54 and a second branch 56. The first and second branches 54, 56 can extend away from the axis X and can be disposed on opposite sides of the axis X. In addition, the posterior rib 52 can include a central through hole 58, which is polygonal and is substantially centered on the axis X. The posterior rib 52 can further include a plurality of secondary through holes **60*a*, 60*b*, which are each polygonal in shape and are disposed on opposite sides of the axis X. The posterior rib 52 can extend from the base 32 and can extend generally in a superior direction toward the posterior area 16 of the upper 12. Accordingly, the posterior rib 52** can be disposed over the back of the heel of the wearer and can provide cushioned support for the wearer's heel.

Still further, the medial portion 38 of the bladder 30 can include a plurality of forward ribs 62*a*, 62*b*, 62*c*, as shown in FIGS. 4 and 5. Each of the forward ribs 62*a*, 62*b*, 62*c* can be elongate and can be non-linear in plan view (FIG. 5). The forward ribs 62*a*, 62*b*, 62*c* can be spaced apart relative to each other along the axis X. The forward ribs 62*a*, 62*b*, 62*c* can also extend from the base 32, can wrap around and extend partially through the medial area 18 of the upper 12 to be operatively supported by the upper 12. Furthermore, in some embodiments, the forward ribs 62*a*, 62*b*, 62*c* can wrap around and extend at least partially along the superior forefoot area 22. As such, the forward ribs 62*a*, 62*b*, 62*c* can provide cushioned support for the medial toes of the wearer.

The medial portion 38 can also include a plurality of rearward ribs 64*a*, 64*b*. Each of the rearward ribs 64*a*, 64*b* can be elongate and can be non-linear in plan view (FIG. 5). The rearward ribs 64*a*, 64*b* can be spaced apart relative to each other along the axis X. The rearward ribs 64*a*, 64*b* can also extend from the base 32, can wrap around and extend partially through the medial area 18 of the upper 12 to be operatively supported by the upper 12. As such, the rearward ribs 64*a*, 64*b* can provide cushioned support for the medial portion of the heel and ankle of the wearer.

Also, the medial portion 38 can include a central rib 66. The central rib 66 can be substantially wider than the forward and rearward ribs 62*a*, 62*b*, 62*c*, 64*a*, 64*b*. Also, the central rib 66 can include a plurality of branches 68*a*, 68*b*, 68*c*, 68*d* that extend either toward the anterior portion 34 or the posterior portion 36 of the bladder 30. Moreover, the central rib 66 can include a central hole 70 (FIG. 5), which is polygonal in shape and is disposed between the branches 68*a*, 68*b*, 68*c*, 68*d*. The central rib 66 can extend from the base 32 and can wrap around in a superior direction toward the medial area 18 of the upper 12 to be operatively supported by the upper 12. Accordingly, the central rib 66 can provide cushioned support for the central, medial portion of the wearer's foot.

The lateral portion 40 of the bladder 30 can include a plurality of forward ribs 72*a*, 72*b*, 72*c*, as shown in FIGS. 4 and 5. Each of the forward ribs 72*a*, 72*b*, 72*c* can be elongate and can be non-linear in plan view (FIG. 5). The forward ribs 72*a*, 72*b*, 72*c* can be spaced apart relative to each other along the axis X. The forward ribs 72*a*, 72*b*, 72*c* can also extend from the base 32, can wrap around and extend partially through the lateral area 20 of the upper 12 to be operatively supported by the upper 12. Furthermore, in some embodiments, the forward ribs 72*a*, 72*b*, 72*c* can wrap around and extend at least partially along the superior forefoot area 22. As such, the forward ribs 72*a*, 72*b*, 72*c* can provide cushioned support for the lateral toes of the wearer.

The lateral portion 40 can also include a plurality of rearward ribs 74*a*, 74*b*. Each of the rearward ribs 74*a*, 74*b* can be elongate and can be non-linear in plan view (FIG. 5). The rearward ribs 74*a*, 74*b* can be spaced apart relative to each other along the axis X. The rearward ribs 74*a*, 74*b* can also extend from the base 32, can wrap around and extend partially through the lateral area 20 of the upper 12 to be operatively supported by the upper 12. As such, the rearward ribs 74*a*, 74*b* can provide cushioned support for the lateral portion of the heel and ankle of the wearer.

Also, the lateral portion 40 can include a central rib 76. The central rib 76 can be substantially wider than the forward and rearward ribs 72*a*, 72*b*, 72*c*, 74*a*, 74*b*. Also, the central rib 76 can include a plurality of branches 78*a*, 78*b*, 78*c*, 78*d* that extend either toward the anterior portion 34 or the posterior portion 36 of the bladder 30. The forward rib 72*c* can be joined to the branch 78*a* of the central rib 76 as shown in FIG. 5, and the forward rib 72*c* and branch 78*a* can be in fluid communication with each other. In some embodiments, the bladder 30 can be filled with fluid through the forward rib 72*c* and branch 78*a* of the central rib 76, and then the forward rib 72*c* and branch 78*a* can be substantially hermetically sealed. Moreover, the central rib 76 can include a central hole 80 (FIG. 5), which is polygonal in shape and is disposed between the branches 78*a*, 78*b*, 78*c*, 78*d*. The central rib 76 can extend from the base 32 and can wrap around in a superior direction toward the lateral area 20 of the upper 12 to be operatively supported by the upper 12. Accordingly, the central rib 76 can provide cushioned support for the central, lateral portion of the wearer's foot.

As shown in FIG. 5, the bladder 30 can be substantially symmetric about the axis X. For instance, the ribs 62*a*-62*c*, 64*a*-64*b*, 66, 72*a*-72*c*, 74*a*, 74*b*, 76 can radiate substantially symmetrically from the base 32. More specifically, the posterior rib 52 and the anterior rib 50 can extend substantially symmetrically on both sides of the axis X. Furthermore, the medial portion 38 and the lateral portion 40 can include the same number of ribs 62*a*-62*c*, 64*a*-64*b*, 66, 72*a*-72*c*, 74*a*, 74*b*, 76. In addition, each of the forward ribs 62*a*-62*c* can be at approximately the same longitudinal position along the axis X as corresponding ones of the forward ribs 72*a*-72*c*. Likewise, the central ribs 66, 76 of the medial and lateral portions 38, 40 can be at substantially the same longitudinal position along the axis X. Moreover, the rearward ribs 64*a*, 64*b* of the medial portion 38 can be at substantially the same longitudinal position along the axis X as the rearward ribs 74*a*, 74*b* of the lateral portion 40.

Accordingly, the bladder 30 of the article of footwear 10 can wrap around and cradle the foot of the wearer. This is because the bladder 30 extends about and cushions a substantial part of the foot. However, the bladder 30 is unlikely to increase the weight of the footwear 10 because it is fluid-filled and because it includes elongate ribs 62*a*-62*c*, 64*a*-64*b*, 66, 72*a*-72*c*, 74*a*, 74*b*, 76. Accordingly, the footwear 10 can provide improved fit, comfort, and support of the foot.

Figure 6:
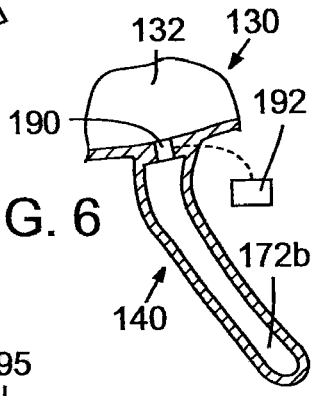
FIG. 6 is a detail view of another exemplary embodiment of the bladder of FIG. 1.

Referring now to FIG. 6, another embodiment of the bladder 130, is illustrated. Components that are similar those of FIGS. 1-5 are identified with corresponding reference numbers increased by 100.

As shown in FIG. 6, the base 132 of the bladder 130 is in selective fluid communication with the forward rib 172*b* of the lateral portion 140. More specifically, the bladder 130 can include a valve 190 that is disposed between the base 132 and the rib 172*b*. The valve 190 can be of any suitable type, such as a one-way valve or a two-way valve. The bladder 130 can further include a control device 192, which is in operative communication with the valve 190. In some exemplary embodiments, the control device 192 can be a button or another user-activated control device. Thus, by manipulating the control device 192, the user can selectively allow fluid communication between the base 132 and the rib 172*b*. Also, the control device 192 can be biased toward a closed position of the valve 190 to selectively stop communication between the base 132 and the rib 172*b*. It will be appreciated that valve 190 can be included at any location on the bladder 130 and can affect fluid communication of any desired rib 62*a*-62*c*, 64*a*-64*b*, 66, 72*a*-72*c*, 74*a*, 74*b*, 76. Also, the bladder 130 can include a plurality of valves 190 operatively disposed between the base 132 and any of the other ribs 62*a*-62*c*, 64*a*-64*b*, 66, 72*a*-72*c*, 74*a*, 74*b*, 76. Accordingly, the valve 190 and the control device 192 can allow the user to change the pressure within the bladder 130 according to the wearer's desires. Thus, the bladder 130 can be more adaptable and more versatile.

Figure 7:
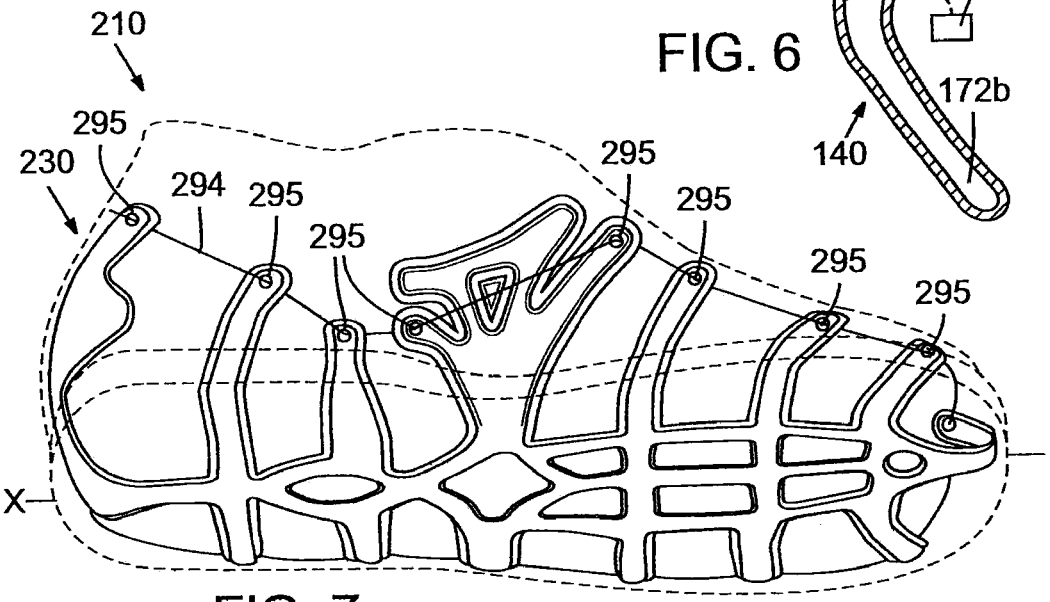
FIG. 7 is a perspective view of another exemplary embodiment of the bladder of FIG. 1.

Referring now to FIG. 7, another embodiment of the bladder 230 will be discussed. Components that are similar to the components of FIGS. 1-5 will be identified with corresponding reference numerals increased by 200.

As shown, the bladder 230 can include an attachment device 294. The attachment device 294 can be a thread, rope, bungee cord, rigid cord, or any other suitable type. Also, the bladder 230 can include a plurality of holes 295 included at respective ends of the ribs 250, 252, 262*a*-262*c*, 264*a*, 264*b*, 266, 272*a*-272*c*, 274*a*-274*b*, 276 of the bladder 230. The attachment device 294 can be threaded through the plurality of holes 295 to thereby maintain the ribs 250, 252, 262*a*-262*c*, 264*a*, 264*b*, 266, 272*a*-272*c*, 274*a*-274*b*, 276 wrapped around the foot of the wearer. Accordingly, the attachment device 294 can maintain the bladder 230 in position against the foot to ensure proper support and fit. Also, in some embodiments, the attachment device 294 can facilitate manufacturing of the article of footwear 210 because the bladder 230 is held in a desired shape while the footwear 210 is assembled.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An article of footwear comprising:

an upper having a medial side, a lateral side, a toe portion, and a heel portion;

a sole assembly connected to the upper and including a ground-engaging surface and a midsole disposed between the ground-engaging surface and the upper;

a fluid-filled bladder including a base disposed between the sole assembly and the upper and a plurality of ribs in fluid communication with the base, the plurality of ribs including a first rib and a second rib extending from the base onto the medial side of the upper; and an attachment device extending along a surface of the medial side of the upper, between the first rib and the second rib, and directly connecting the first rib and the second rib.

2. The article of footwear of claim 1, wherein the first rib and the second rib each include a first end attached to the base and a second end disposed on an opposite side of the first rib and the second rib than the first end, the second end receiving the attachment device.

3. The article of footwear of claim 1, wherein the attachment device is one of a thread, a rope, a bungee cord, and a rigid cord received within apertures respectively formed in the first rib and the second rib.

4. The article of footwear of claim 1, wherein the plurality of ribs includes a third rib and a forth rib extending from the base onto the lateral side of the upper.

5. The article of footwear of claim 4, wherein the attachment device extends along the lateral side of the upper and connects the third rib and the fourth rib.

6. The article of footwear of claim 1, wherein the plurality of ribs includes a third rib extending onto the toe portion of the upper and a fourth rib extending onto the heel portion of the upper.

7. The article of footwear of claim 6, wherein the attachment device is attached to at least one of the third rib and the fourth rib.

8. The article of footwear of claim 1, wherein the base is disposed between the midsole and the upper.

9. The article of footwear of claim 1, wherein the base include at least one aperture formed therethrough, the at least one aperture receiving a material of the midsole therein.

10. The article of footwear of claim 1, wherein the first rib and the second rib are exposed at the upper.

11. The article of footwear of claim 1, wherein the first rib and the second rib are received between a first layer of the upper and a second layer of the upper.

12. The article of footwear of claim 1, further comprising a valve associated with at least one of the first rib and the second rib, the vale operable to selectively prevent fluid communication between the base and the at least one of the first rib and the second rib.

13. An article of footwear comprising:

an upper having a medial side, a lateral side, a toe portion, and a heel portion;

a sole assembly connected to the upper and including a ground-engaging surface and a midsole disposed between the ground-engaging surface and the upper;

a fluid-filled bladder including a base disposed between the sole assembly and the upper and a plurality of ribs in fluid communication with the base, the plurality of ribs including a first rib extending onto the heel portion of the upper and a second rib extending from the base onto the toe portion of the upper; and an attachment device extending continuously along a surface of at least one of the medial side of the upper and the lateral side of the upper between the first rib and the second rib and directly connecting the first rib and the second rib.

14. The article of footwear of claim 13, wherein the first rib and the second rib each include a first end attached to the base and a second end disposed on an opposite side of the first rib and the second rib than the first end, the second end receiving the attachment device.

15. The article of footwear of claim 13, wherein the attachment device is one of a thread, a rope, a bungee cord, and a rigid cord received within apertures respectively formed in the first rib and the second rib.

16. The article of footwear of claim 13, wherein the plurality of ribs includes a third rib and a forth rib extending from the base onto one of the medial side of the upper and the lateral side of the upper.

17. The article of footwear of claim 16, wherein the attachment device connects the third rib and the fourth rib to the first rib and the second rib.

18. The article of footwear of claim 13, wherein the base is disposed between the midsole and the upper.

19. The article of footwear of claim 13, wherein the base include at least one aperture formed therethrough, the at least one aperture receiving a material of the midsole therein.

20. The article of footwear of claim 13, further comprising a valve associated with at least one of the first rib and the second rib, the vale operable to selectively prevent fluid communication between the base and the at least one of the first rib and the second rib.

* * * * *